US005877592A

United States Patent [19]

Hesterman et al.

[11] Patent Number: 5,877,592

[45] Date of Patent: Mar. 2, 1999

[54] PROGRAMMED-START PARALLEL-RESONANT ELECTRONIC BALLAST

[75] Inventors: Bryce L. Hesterman, Fort Wayne; Ben A. Beer, Ossian, both of Ind.

[73] Assignee: MagneTek, Inc., Nashville, Tenn.

[21] Appl. No.: 742,355

[22] Filed: Nov. 1, 1996

[51] Int. Cl.[6] ..... H05B 39/04

[52] U.S. Cl. ..... 315/106; 315/105; 315/DIG. 7; 315/224; 315/291

[58] Field of Search ..... 315/106, 105, 315/DIG. 7, 291, 224

[56] References Cited

U.S. PATENT DOCUMENTS

| | | | |
|---|---|---|---|
| 4,277,726 | 7/1981 | Burke | 315/98 |
| 4,513,226 | 4/1985 | Josephson | 315/219 |
| 4,692,667 | 9/1987 | Nilssen | 315/209 |
| 4,698,553 | 10/1987 | Nilssen | 315/200 |
| 4,700,287 | 10/1987 | Nilssen | 363/132 |
| 4,920,299 | 4/1990 | Presz et al. | 315/105 |
| 4,928,039 | 5/1990 | Nilssen | 315/209 |
| 4,949,015 | 8/1990 | Nilssen | 315/200 |
| 5,055,746 | 10/1991 | Hu | 315/291 |
| 5,166,869 | 11/1992 | Hesterman | 363/25 |
| 5,191,263 | 3/1993 | Konopka | 315/209 |
| 5,367,223 | 11/1994 | Eccher | 315/DIG. 7 |
| 5,416,386 | 5/1995 | Nilssen | 315/209 |

*Primary Examiner*—Robert J. Pascal
*Assistant Examiner*—Michael Shingleton
*Attorney, Agent, or Firm*—Waddey & Patterson; Mark J. Patterson

[57] ABSTRACT

A family of programmed start parallel-resonant electronic ballast circuits operate in a first mode during a preheat interval following application of power to the ballast, and then afterwards operate in a second mode. The ballast circuits can be based on any of the several forms of current-fed parallel-resonant inverters, all of which have a dc choke inductor. A first embodiment operates such that, during the first mode, the parallel-resonant inverter is inhibited, while an auxiliary transistor develops a trapezoidal voltage waveform across the dc choke inductor. Filament preheating is provided by windings coupled to the dc choke inductor. The ballast output voltage is essentially zero so that no destructive glow current is produced. During the second mode, the auxiliary transistor is inhibited, and the parallel-resonant inverter produces a sinusoidal output voltage. The rms magnitude of the filament heating voltage is reduced by about fifty percent as the waveshape changes from the trapezoidal shape to a form similar to that of a full-wave rectified sine-wave in which the dc component has been removed. In an alternative embodiment, the waveforms of the first embodiment are produced without using an auxiliary transistor. During the first mode, all of the switching transistors of the parallel-resonant inverter are operated in unison. During the second mode, they are switched in the normal out-of-phase manner.

24 Claims, 8 Drawing Sheets

PROGRAMMED-START PARALLEL-RESONANT ELECTRONIC BALLAST

BACKGROUND OF THE INVENTION

This invention relates to electronic ballasts that provide filament heating before applying the lamp starting voltage, a technique known as programmed starting. More specifically, it relates to ballast circuits that utilize dual-mode inverters to achieve filament preheating.

Fluorescent lamps have filaments that must be heated in order to provide thermionic electron emission. The filaments are coated with an emissive material such as barium oxide that has a low work function. Rapid-start fluorescent lamps have two terminals for each filament so that the filament can be heated with a filament voltage before the lamp is started. Ballasts that supply a filament voltage are commonly known as rapid-start, preheat-start, programmed-start, or soft-start ballasts. The term "soft-starting" is used herein as a generic term for all starting methods that heat the filaments before starting the lamp.

Ballasts that do not supply a lamp filament heating voltage are called instant-start ballasts. These ballasts supply a high starting voltage which causes some of the mercury vapor in the lamp to become ionized. The filaments are heated as they are bombarded by mercury ions which are accelerated by the high starting voltage. An arc is established in the lamp when the filaments become sufficiently hot. Once the lamp has been struck, the arc current flowing through the filaments provides heating, and ion bombardment is greatly reduced. The high level of ion bombardment that occurs during starting causes some of the emissive coating on the filaments to be sputtered away. Lamp failure occurs soon after the emissive material is worn away. Quick-cycle accelerated life tests show that, with properly designed electronic ballasts, typical rapid-start fluorescent lamps can be instant-started 10,000 to 15,000 times before failing.

Lamp life can be improved by using soft starting methods. There are several prior-art methods for achieving soft starting, but each method has significant disadvantages. Many soft-starting ballasts utilize series-resonant inverters. These inverters tend to supply a relatively constant output current, so multi-lamp series-resonant ballasts typically have the lamps connected in series. If one lamp in a series string fails, then all of the lamps are extinguished.

It is desirable to have parallel-connected lamps so that the failure of one lamp will not cause the other lamps supplied by the ballast to extinguish. The term "parallel-connected" means that the ballast has parallel output current paths. Each path includes a lamp in series with a ballasting impedance to limit the lamp current. Current-fed parallel-resonant inverters supply a constant output voltage instead of a constant output current, so they can be used to supply power to parallel-connected lamps.

A current-fed parallel-resonant inverter is a dc-to-ac inverter that has a parallel-resonant tank circuit, a dc choke inductor, and two sets of controlled switching devices that cause an alternating current to flow through the parallel-resonant tank such that an essentially sinusoidal voltage is developed across the parallel-resonant tank. Each controlled switching device set contains at least one controlled switching device such as a transistor. The parallel-resonant tank circuit consists of at least one resonating inductance, and one or more capacitances, each of which is effectively connected in parallel with a resonating inductance. The resonating inductances in the tank circuit are all coupled to each other.

They are typically the magnetizing inductances of transformer windings, but current-fed parallel-resonant inverters can also be constructed in a non-isolated manner. Examples of various types of current-fed parallel-resonant inverters are described in U.S. Pat. Nos.: 4,277,726; 4,513,226; 4,692,667; 5,055,746; 5,166,869; and 5,416,386. It should be noted that parallel-loaded series-resonant inverters are sometimes called parallel-resonant inverters, but that is a misnomer. The term "parallel-resonant inverter" as used herein refers specifically to current-fed parallel-resonant inverters. Ballasts that use parallel-resonant inverters are typically referred to as parallel-resonant ballasts, while ballasts that use series-resonant inverters are typically called series-resonant ballasts.

In many soft-starting schemes for both series-resonant and parallel-resonant inverters, the output voltage during the preheating period is great enough that a small lamp current called a glow current is produced. The glow current causes filament erosion due to mercury ion bombardment. Consequently, many soft starting ballasts achieve only a modest improvement over instant start ballasts in the typical number of starts before lamp failure. Some soft starting ballasts have enough glow current that they are actually worse that instant start ballasts. Soft starting ballasts that have a substantial output voltage during the preheating interval are described in U.S. Pat. Nos. 4,277,726 and 5,191,263.

The ideal way to reduce lamp damage during starting is to prevent glow current during the time that the filaments are being heated by maintaining a very low voltage across the lamps during the preheat interval. This technique, known as programmed starting, can substantially increase lamp life in comparison with other methods. Quick-cycle accelerated life tests have shown that properly designed programmed start ballasts can start lamps hundreds of thousands of times before lamp failure occurs. Increasing the number of starts before lamp failure is particularly important when occupancy sensors are used to control ballast operation since they may switch as often as 10 to 50 times per day. In addition to controlling the lamp voltage during starting, programmed start ballasts also control the filament heating voltage. In order to save energy, the filament heating voltage is high during preheating and lower during normal operation.

The ballast output voltage during preheating can be eliminated if an auxiliary inverter is used to heat the filaments. U.S. Pat. Nos. 4,698,553 and 4,928,039 show half-bridge series-resonant ballast circuits that utilize a separate half-bridge inverter to pre-heat the filaments before the main inverter strikes the lamps. After the preheating interval is over, the auxiliary inverter can be shut off to save energy. This approach requires a considerable amount of extra circuitry, and is not suited for parallel lamp operation.

A related approach is shown in U.S. Pat. Nos. 4,700,287 and 4,949,015. These patents show series-resonant ballasts which utilize two half-bridge inverters. During the preheat interval, the first half bridge supplies ac voltage to a filament transformer. During normal operation, the second half-bridge is operated out of phase with the first half-bridge to form a full-bridge inverter which drives a series-resonant tank circuit. As with the auxiliary inverter approach, the half-bridge/full-bridge approach shown in these patents also requires a considerable amount of extra circuitry, and is not suited for parallel lamp operation. This approach further lacks the capability of reducing the filament voltage during normal operation.

SUMMARY

The object of the invention is to provide programmed start parallel-resonant electronic ballast circuits that operate in a first mode during a predetermined preheat interval following application of power to the ballast, and then afterwards operate in a second mode. When operating in the first mode, the ballast circuits provide filament preheating while maintaining essentially zero output voltage. When operating in the second mode, the ballast circuits provide reduced filament heating, and supply a current-limited output voltage that is sufficient to strike and operate fluorescent lamps. The reduced filament voltage is great enough to allow hot relamping, so that lamps which are replaced while the ballast is operating will be started without having to cycle the input power to the ballast to initiate the starting sequence.

In a first embodiment of the invention, a programmed start ballast circuit having a parallel-resonant inverter receives power from a dc power supply and provides high-frequency power to operate one or more fluorescent lamps. The parallel-resonant inverter has a dc choke inductor, a resonating inductance, a resonating capacitance, and first and second sets of main switching transistors, each of which contains at least one transistor. The resonating capacitance is effectively connected in parallel with the resonating inductance to form a parallel-resonant tank circuit. The dc choke inductor has at least one main winding and at least two additional windings that are used to provide filament heating. The resonant inductance is typically supplied by a resonant transformer that has a relatively low magnetizing inductance for storing energy. Non-isolated operation using a resonant inductor instead of a resonant transformer is also possible. An example of a non-isolated parallel-resonant inverter is shown in U.S. Pat. No. 4,692,667.

In the first operating mode, the parallel-resonant inverter is inhibited, and an auxiliary switching transistor is used to develop an ac voltage across the main winding of the dc choke inductor while producing essentially no voltage in the parallel-resonant tank circuit. The voltage waveforms present on the dc choke inductor windings have shapes that are approximately trapezoidal. The term trapezoidal, as used herein, includes waveshapes that are clearly trapezoidal as well waveshapes that are nearly square, but have finite slopes. The dc choke inductor voltage waveforms may have some overshoot or ringing due to imperfect coupling among the windings.

During the second operating mode, the auxiliary switching transistor is inhibited, and the main switching transistors are used to develop a sinusoidal voltage in the parallel-resonant tank circuit. The first main transistor set is operated out of phase with the second main transistor set.

The rms value of the ac voltage across the dc choke inductor windings during the second mode is about fifty percent of the magnitude present during the first mode. The dc choke inductor voltage waveshape changes from a trapezoidal shape to a pattern similar to that of a full-wave rectified sine wave in which the dc component is removed so that the average inductor voltage is approximately zero.

A timing circuit is used to determine the length of the first operating mode, and to initiate the transition to the second operating mode.

An alternative embodiment eliminates the auxiliary switching transistor, but uses a more complicated inverter control circuit for the main transistors. During the first operating mode, both sets of main switching transistors are turned on and off in unison so as to develop trapezoidal voltage waveforms across the windings of the dc choke inductor while producing essentially no voltage in the parallel-resonant tank circuit. During the second operating mode, the two sets of main transistors are operated in the same out-of-phase manner used in the first embodiment.

The present invention allows any parallel-resonant inverter topology to be adapted to form a dual-mode inverter that can be used to implement a programmed-start electronic ballast.

DETAILED DESCRIPTION OF THE PREFERRED EMBODIMENTS

Figure 1:
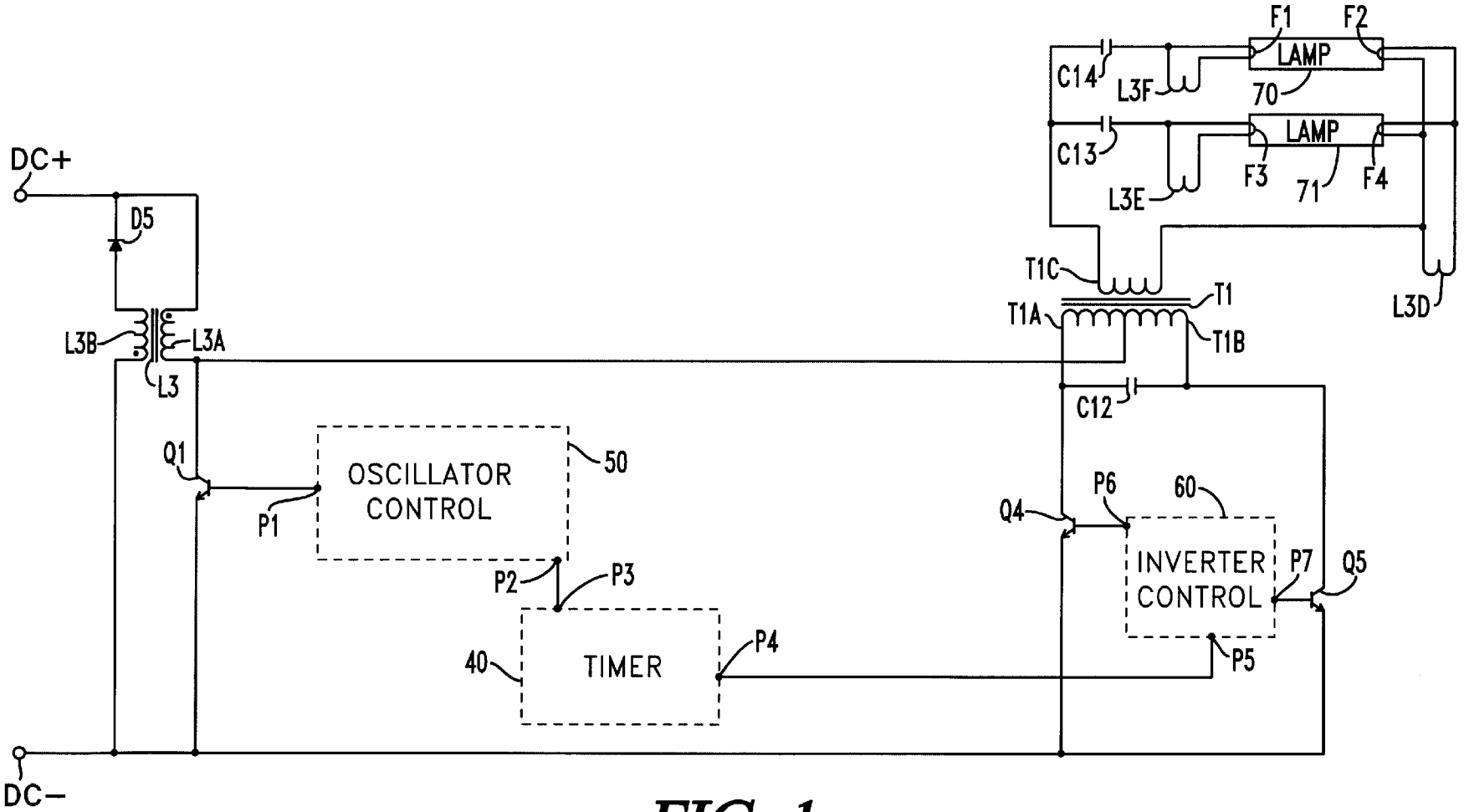
FIG. 1 is a simplified diagram of a programmed start electronic ballast having a dual-mode, push-pull parallel-resonant inverter.

FIG. 1 shows a simplified diagram of a programmed start electronic ballast having a dual-mode, push-pull parallel-resonant inverter. A source of dc power (not shown) supplies power to the ballast through terminals DC+ and DC−. The dc power source is typically a rectifier circuit having either active or passive power factor correction.

A dc choke inductor L3 has a main winding L3A, a clamping winding L3B, and filament windings L3D, L3E, and L3F. Winding L3A and an NPN power switching transistor Q1 are connected in series between DC+ and DC−. Winding L3B and a diode D5 are also connected in series between DC+ and DC−.

An oscillator control circuit 50 has an output terminal P1, and an inhibit terminal P2. Output terminal P1 is connected to the base of transistor Q1. A timer circuit 40 has a first timer output terminal P3 and a second timer output terminal P4. Inhibit terminal P2 is connected to timer output P3.

The resonant inverter topology utilized in FIG. 1 is commonly referred to as a push-pull parallel-resonant inverter. A transformer T1 has a center-tapped primary winding comprised of windings T1A and T1B, and a secondary winding T1C. L3A is connected between DC+ and the junction of windings T1A and T1B. A capacitor C12 is connected in parallel with the entire primary winding of transformer T1 to form a parallel-resonant tank circuit. A pair of NPN power switching transistors, Q4 and Q5, are connected between DC− and windings T1A and T1B. The emitter-to-collector capacitances of transistors Q1, Q4, and Q5 are effectively connected in parallel with the primary winding of transformer T1. The self capacitance of inductor L3 is also effectively part of the parallel-resonant tank capacitance. In contrast, it can be shown that the inductance of winding L3A is not effectively in parallel with the primary winding of transformer T1, and that the inductance value of winding L3A has little effect on the resonant frequency of the parallel-resonant tank. Consequently, the inductance value of winding L3A can be chosen to be small enough that the current through winding L3A has substantial ripple without having a significant effect on the operation of the parallel-resonant inverter.

An alternative realization of the push-pull parallel-resonant inverter of FIG. 1 can be obtained by repositioning winding L3A. To form an embodiment of the present invention using the alternative inverter, the junction of windings T1A and T1B is connected to DC+, and winding L3A is inserted between DC− and the junction of the emitters of transistors Q4 and Q5. Transistor Q1 is connected between DC+ and the junction of the emitters of transistors Q4 and Q5.

An inverter control circuit 60 has an input terminal P5, a first output terminal P6, and a second output terminal P7. Input terminal P5 is connected to timer output terminal P4. Output terminal P6 is connected to the base of transistor Q4, and output terminal P7 is connected to the base of transistor Q5.

Fluorescent lamp 70 has filaments F1 and F2, and fluorescent lamp 71 has filaments F3 and F4. Winding L3F is connected to filament F1, and winding L3E is connected to filament F3. Winding L3D is connected to filaments F2 and F4, and to winding T1C. Although they are not explicitly shown in FIG. 1 or in FIGS. 3–8, each of the ballast circuits has a set of output terminals connected to the dc choke filament windings so as to facilitate connected of the ballast to the lamp load. A ballast capacitor C13 is connected between winding T1C and winding L3E, and a ballast capacitor C14 is connected between winding T1C and winding L3F.

A preheat interval begins when power is first applied to the ballast. Oscillator control 50 causes transistor Q1 to switch on and off at a frequency on the order of 40 kHz, and timer 40 begins operating. Timer output P3 is initially in a state that allows oscillator control 50 to operate, and timer output P4 is in a state that inhibits inverter control 60 through input terminal P5. The two outputs of timer 40 remain in these states for the duration of the preheat interval. The preheat interval should be designed to last for a period that ranges from about 300 milliseconds to 1.5 seconds, depending upon the supplied filament voltage and the characteristics of the filaments.

Figure 2A:
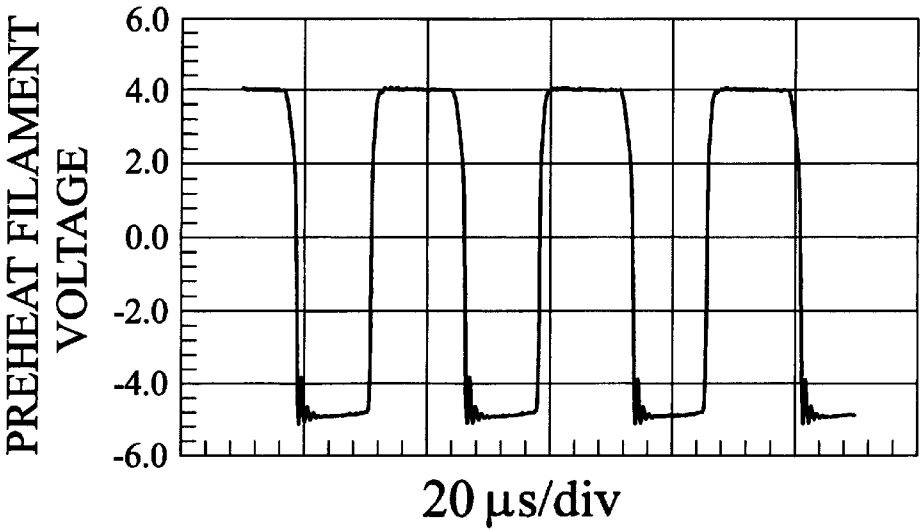
FIGS. 2*a* and *b* shows plots of filament voltage waveforms during preheat and normal operation modes for the programmed start electronic ballast circuit of FIG. 1.
Figure 2B:
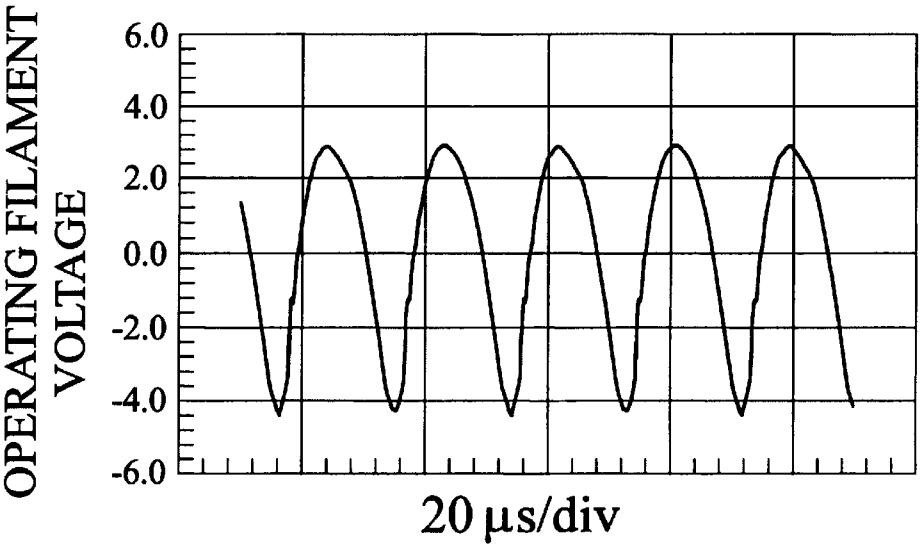

FIG. 2 shows plots of filament voltage waveforms of an implementation of FIG. 1 that was designed to operate 32 watt T8 lamps. During the preheat interval, the filament windings have a voltage of about 4 volts rms as shown in FIG. 2(*a*). The windings of inductor L3 each have a waveform that is approximately a squarewave. The filament voltage shown in FIG. 2(*a*) is negative when transistor Q1 is on, and positive when diode D5 is on. There is essentially no voltage across the windings of T1 during the preheat interval.

At the end of the preheat interval, timer output P3 supplies an inhibit signal to inhibit input P2 of oscillator control 50. Timer output P4 supplies a starting signal to input P5 of inverter control 60. Outputs P6 and P7 of inverter control 60 then supply signals to the bases of transistors Q4 and Q5 that cause them to alternately switch at, or slightly below, the resonant frequency of the parallel-resonant tank circuit. Transistor Q4 is operated out of phase with transistor Q5. The switching action of transistors Q4 and Q5 develops a sinusoidal voltage across the windings of transformer T1. Transistors Q4 and Q5 switch at the zero crossings of the sinusoidal tank voltage. The voltage across winding T1C causes lamps 70 and 71 to strike. The impedance of ballast capacitors C13 and C14 limits the lamp current. Ballasting impedance can also be provided by inductors or leakage inductance instead of capacitors C13 and C14. When the lamps are operating, capacitors C13 and C14 become part of the resonant circuit, and they decrease the resonant frequency. Inverter control 60 is designed to sense this, and automatically reduces the switching frequency to maintain zero-voltage switching.

During normal operation, the windings of inductor L3 each have a voltage waveform that has a shape similar to a full-wave rectified sine wave in which the dc component is removed so that the average value of the waveform is essentially zero. A plot of the filament voltage during normal operation is shown in FIG. 2(*b*). The rms value of this voltage is about 2 volts. The frequency is typically about 50 kHz, and is twice the frequency of the sinusoidal voltages across the windings of T1. The filament voltage is low enough to cause a significant drop in the filament power, but large enough to allow hot relamping.

During the preheat interval, the rms value of the filament voltage, $V_{fil}$, is approximately equal to:

$$V_{fil} = \frac{V_{dc}}{N_{AF}} \sqrt{\frac{1}{N_{BA}}} \tag{1}$$

where $V_{dc}$ is the voltage between DC+ and DC−, $N_{AF}$ is the number of turns of main winding L3A divided by the number of turns in each of the filament output windings of L3, and $N_{BA}$ is equal to the number of turns of winding L3B divided by the number of turns of winding L3A. When the parallel-resonant inverter is operating, the rms value of $V_{fil}$ is approximately:

$$V_{fil} = \frac{V_{dc}}{N_{AF}} \sqrt{\frac{\pi^2}{8} - 1} \tag{2}$$

This results in nearly a 50% cutback in the filament voltage.

Figure 3:
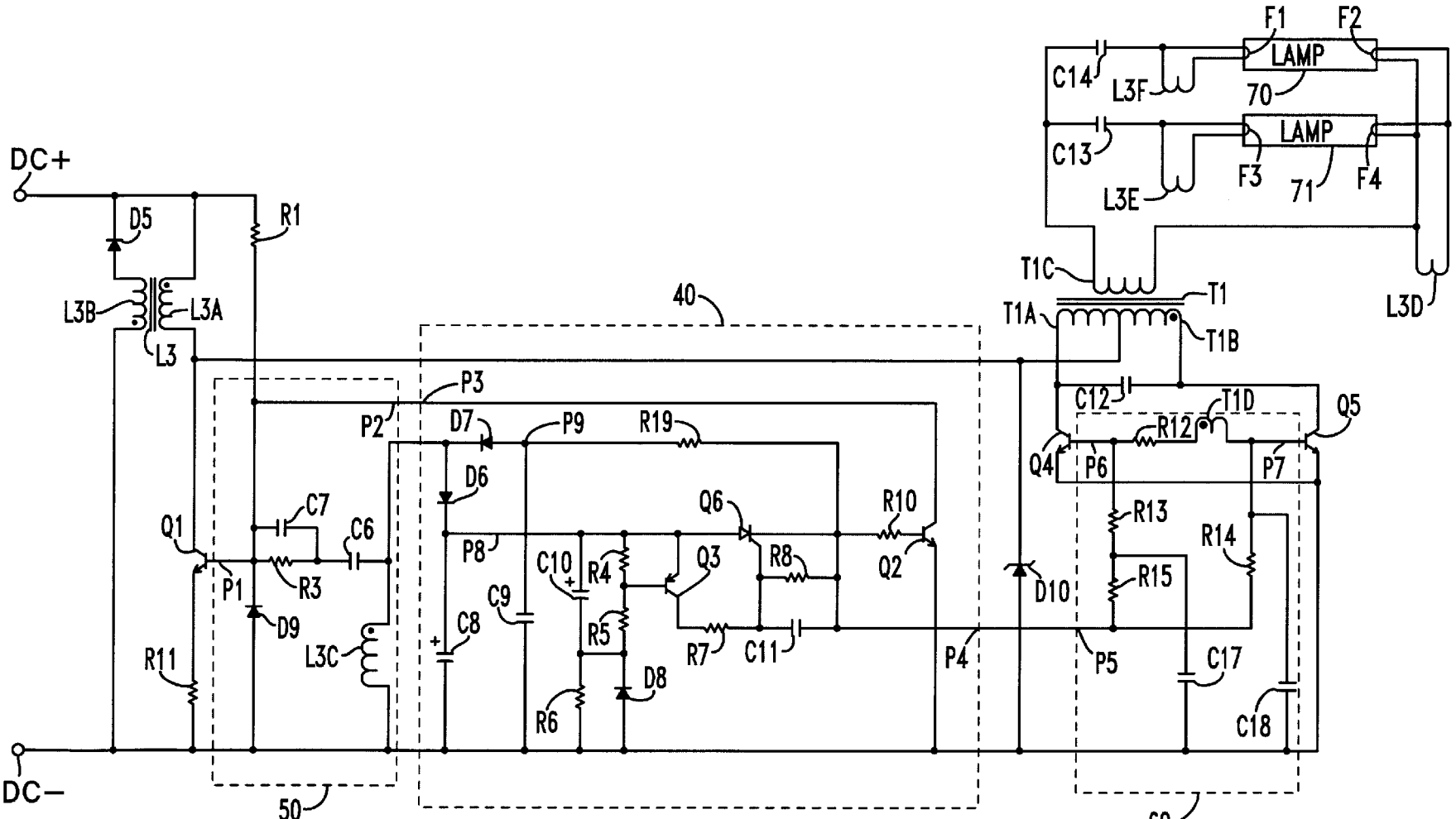
FIG. 3 is a detailed electrical schematic diagram of the preferred embodiment of the electronic ballast circuit of FIG. 1.

FIG. 3 shows a more detailed version of the circuit of FIG. 1. Oscillator control 50 is implemented as a blocking oscillator. A resistor R1 is connected between DC+ and the base of transistor Q1 to provide a trickle starting current. In addition to the two windings shown in FIG. 1, inductor L3 has a third winding, L3C, to provide positive feedback for the oscillator. A base drive network consisting of a current limiting resistor R3, a dc blocking capacitor C6, and a speed-up capacitor C7 couples the feedback signal from the dotted end of winding L3C to the base of transistor Q1 through terminal P1. Capacitor C6 prevents winding L3C from shunting the trickle starting current away from the base of transistor Q1. Capacitor C7 aids starting and improves the switching speed by enhancing the level of positive feedback during intervals when Q1 is switching on or off. Resistor R3 sets the base current level when transistor Q1 is on. A diode D9 is connected between the base of transistor Q1 and DC− to provide a reverse current path for the base drive network. In FIG. 3, a resistor R11 that is not shown in FIG. 1 is inserted between the emitter of transistor Q1 and DC− to provide current limiting in case one or more of the filament windings is inadvertently shorted.

Transistor Q1 turns on at the beginning of each switching cycle of the blocking oscillator, and the collector current jumps to a level set by the filament load. The collector current then ramps up as energy is stored in inductor L3. When the current is sufficiently high, transistor Q1 comes out of saturation and the collector-to-emitter voltage starts to increase. Transistor Q1 is then turned off by positive feedback supplied by the base-drive circuit. The collector voltage swings above DC+ as the release of energy stored in inductor L3 reverses the polarity of the voltage across each of the windings of L3. Diode D9 resets the voltage across capacitors C7 and C6 when the voltage across winding L3C is reversed.

When transistor Q1 turns off, the collector voltage is limited by clamp winding L3B, clamp diode D5, and a zener diode D10 that is connected between the collector of transistor Q1 and DC−. Zener diode D10 also provides protection for inverter transistors Q4 and Q5 during transient conditions. Winding L3B has more turns than winding L3A in order to limit the peak collector voltage to a level that prevents diode D10 from conducting except during a brief interval when the leakage inductance between windings L3A and L3B allows an overshoot in the collector voltage. Some of the energy stored in inductor L3 is delivered to the filament load. The remainder of the stored energy, excluding the amount dissipated as losses, is returned to the dc power source.

In an alternative embodiment, winding L3B and diode D5 are eliminated. Zener diode D10 is selected to have a power rating sufficient to dissipate the portion of the energy stored in L3 that is not delivered to the filament load. With this embodiment, the filament voltage during the preheat mode is approximately:

$$V_{fil} = \frac{V_{dc}}{N_{AF}} \sqrt{\frac{V_z}{V_{dc}} - 1} \tag{3}$$

where $V_z$ is the breakdown voltage of zener diode D10. A dissipative clamping device such as a Metal Oxide Varistor (MOV) can be used in place of zener diode D10.

The on time of transistor Q1 is determined by several factors. The base drive circuit and the gain and storage time characteristics of transistor Q1 determine the current level at which the transistor turns off. The load current determines the initial collector current, and the bulk voltage level and the inductance of winding L3A determine how fast the inductor current ramps up towards the cutoff level. Resistor R11 provides short circuit protection by forcing transistor Q1 to turn off early when large currents are drawn from the output windings. If desired, the current limiting ability of R11 can be enhanced by making D9 a low-voltage zener diode. The available short-circuit output current is limited by the effects of the leakage inductances between L3A and the output windings in combination with the increase in the operating frequency caused by R11.

The end of the off time occurs when the energy in L3 is dissipated and the winding voltages collapse. Because of the necessity to have a volt-second balance on the windings of inductor L3, the off time of transistor Q1 is determined by the turns ratio $N_{BA}$. If the on time of transistor Q1 is $T_{on}$, then the oscillating frequency, $F_{osc}$ is approximately:

$$F_{osc} = \frac{1}{T_{on}(1 + N_{BA})} \tag{4}$$

In the alternative embodiment where clamp winding L3B and clamp diode D5 are eliminated, $F_{osc}$ is approximately:

$$F_{osc} = \frac{V_z - V_{dc}}{T_{on} V_z} \tag{5}$$

The ac voltage across winding L3C is rectified to form two power supplies for timer 40. A diode D6 is connected between winding L3C and an electrolytic capacitor C8 to form a positive power supply at a terminal P8. The voltage between terminal P8 and DC− is about 12 volts. A diode D7 is connected between winding L3C and a capacitor C9 to form a negative power supply at a terminal P9. The voltage at terminal P9 is about −10 volts with respect to DC−. A resistor R19 is connected between negative power supply terminal P9 and timer output terminal P4.

The timing function of timer 40 is provided by an RC network consisting of an electrolytic capacitor C10, and resistors R4, R5, and R6, which are connected in series between terminal P8 and DC−. Capacitor C10 is connected in parallel with resistors R4 and R5, and a diode D8 is connected in parallel with resistor R6. A PNP transistor Q3 has an emitter connected to positive power supply terminal P8, and a base connected to the junction of R4 and R5. The collector of transistor Q3 is coupled to the gate of a silicon controlled rectifier (SCR) Q6 through resistor R7. The anode of SCR Q6 is connected to terminal P8, and the cathode is connected to timer output P4. A resistor R8 and a capacitor C11 are connected in parallel between the gate and cathode of SCR Q6. An NPN transistor Q2 has an emitter connected to DC−, and a collector connected to terminal P3. The base of transistor Q2 is coupled to timer output P4 through a resistor R10.

Inverter control 60 is synchronized to the resonant tank voltage through a feedback winding T1D on transformer T1. The dotted end of winding T1D is coupled to inverter control output P6 through a resistor R12. The other end of winding T1D is connected to inverter control output P7. Resistors R13 and R15 are connected in series between inverter control output P6 and inserter control input P5. A capacitor C17 is connected between DC− and the junction of resistors R13 and R15. A resistor R14 is connected between inverter control output P7 and inverter control input P5. A capacitor C18 is connected between inverter control output P7 and DC−.

During the preheat interval, the square wave voltage present across transistor Q1 is also present across transistors Q4 and Q5. This voltage causes currents to flow through the collector-base junctions of transistors Q4 and Q5. These currents can cause premature starting of the parallel-resonant inverter. Capacitors C17 and C18 shunt these currents away from the base-emitter junctions of transistors Q4 and Q5. A negative bias voltage provided during the preheat interval through resistor R19 and terminals P4 and P5 also aids in preventing premature starting of the parallel-resonant inverter.

When the ballast is first turned on, capacitor C10 will be discharged because of diode D8. When the blocking oscillator begins operating, capacitor C10 is charged through resistor R6. At the end of the preheat interval, the voltage across resistors R4 and R5 is sufficient to turn on transistor Q3, which then turns on SCR Q6 through resistor R7. Resistor R8 and capacitor C11 prevent premature triggering of SCR Q6 by noise signals. When SCR Q6 fires, transistor Q2 is turned on through resistor R10. Transistor Q2 then turns off transistor Q1, which stops the blocking oscillator.

In addition to turning off the blocking oscillator, the triggering of SCR Q6 also allows the parallel-resonant inverter to start. Transistor Q5 is turned on by a bias current that flows through resistor R14. The application of bias current to the base of transistor Q4 is delayed by capacitor C17, which is connected by the junction of bias resistors R13 and R15. This delay allows the inverter to start without hanging up in a condition where both transistors Q4 and Q5 are simultaneously conducting. The capacitance of capacitor C18 is much less than that of capacitor C17 so that the delay caused by capacitor C18 is negligible. Once transistor Q5 is on, winding T1D provides positive feedback to sustain oscillation in the parallel-resonant inverter.

Component values for a ballast built to demonstrate the circuit of FIG. 3 are shown in Table 1.

TABLE 1

Component values for FIG. 3.

| Component | Value or Type | Component | Value or Type |
|---|---|---|---|
| Q1 | BUL128 | R1 | 124K Ω |
| Q2 | 2N4401 | R3 | 510 Ω |
| Q3 | MPS3906 | R4 | 6.2 kΩ |
| Q4, Q5 | BUL128 | R5 | 47 kΩ |
| Q6 | 2N5061 | R6 | 6.2 kΩ |
| D5 | UF4007 | R7 | 10 kΩ |
| D6 | EGP10A | R8 | 1 kΩ |
| D7 | 1N4148 | R10 | 1 kΩ |
| D8 | 1N4148 | R11 | 4.7 Ω |
| D9 | EGP10A | R12 | 1.5 Ω |
| D10 | P6KE320 | R13 | 180 Ω |
| C6 | 10 nF | R14 | 300 Ω |
| C7 | 1 nF | R15 | 120 Ω |
| C8 | 100 uF | R19 | 4.7 kΩ |
| C9 | 100 nF | C13 | 2.7 nF |
| C10 | 100 uF | C14 | 2.7 nF |
| C11 | 47 nF | C17 | 100 nF |
| C12 | 5.6 nF | C18 | 10 nF |

Figure 4:
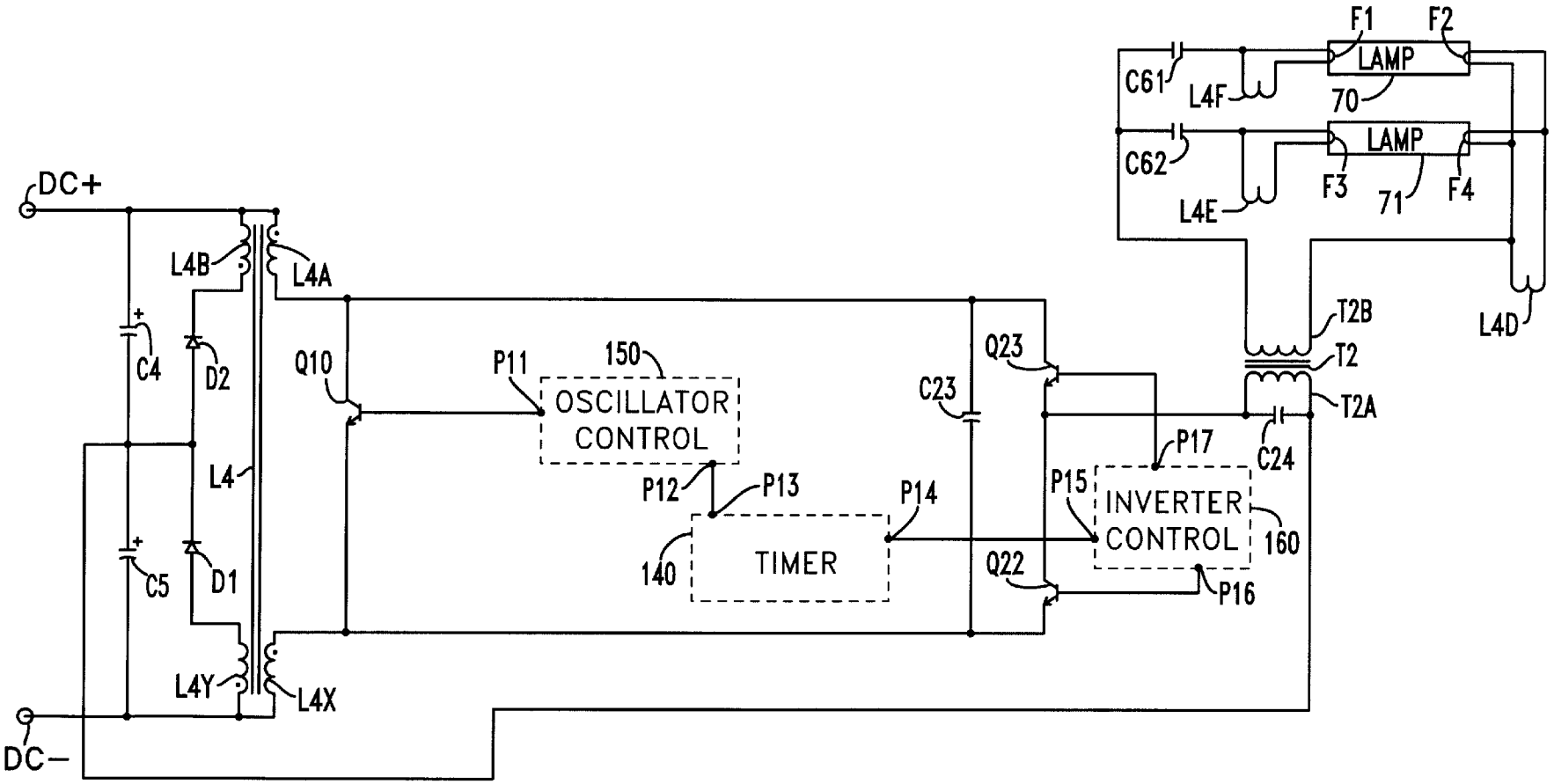
FIG. 4 is a simplified diagram of a programmed start electronic ballast having a dual-mode, half-bridge parallel-resonant inverter.

FIG. 4 shows a simplified diagram of a programmed start electronic ballast that utilizes a half-bridge parallel-resonant inverter. This type of inverter can be used with higher voltages between terminals DC+ and DC− than the push-pull parallel-resonant inverters shown in FIGS. 1 and 3. Under normal operating conditions, the peak voltage that appears across the inverter switching transistors is approximately $\pi$ times the dc input voltage for push-pull parallel-resonant inverters, and $\pi/2$ times the dc input voltage for half-bridge parallel-resonant inverters. The circuit of FIG. 4 is particularly useful when the dc voltage between terminals DC+ and DC− is greater than about 400 volts.

Electrolytic capacitors C4 and C5 are connected in series between terminals DC+ and DC−. These capacitors are typically part of a dc power supply that is not shown. Capacitors C4 and C5 are shown because there are connections to the junction between them. These capacitors do not have to be electrolytic capacitors if sufficient capacitive energy storage is present in the dc power supply. It is possible to leave out either of capacitors C4 or C4 is the dc power supply provides capacitance between DC+ and DC−.

A dc choke inductor L4 has main windings L4A and L4X, clamp windings L4B and L4Y, and filament windings L4D, L4E, and L4F. Winding L4A, an NPN power switching transistor Q10 and winding L4X are connected in series between DC+ and DC−. Winding L4B, diodes D1 and D2, and winding L4Y are also connected in series between DC+ and DC−. The junction where diodes D1 and D2 are connected together is connected to the junction of capacitors C4 and C5. It is possible to use a single clamp winding and diode as in FIG. 1, but the circuit shown in FIG. 4 has the advantage that diodes D1 and D2 each see half the reverse voltage that a single diode would see if only one clamp winding were used.

Main windings L4A and L4X each have pulsating currents, but the sum of the two winding currents going into the dotted ends of the windings is similar to the dc current going into the dotted end of winding L3A of dc choke L3 in FIGS. 1 and 3. Inductor L4 is called a dc choke, even though all of its windings have pulsating currents, because it functions in a manner that is similar to that of dc choke L3. This same reasoning also applies to other parallel-resonant inverter circuits that have multi-winding dc choke inductors with pulsating currents.

An oscillator control circuit 150 has an output terminal P11, and an inhibit terminal P12. Output terminal P11 is connected to the base of transistor Q10. A timer circuit 140 has a first timer output terminal P13 and a second timer output terminal P14. Inhibit terminal P12 is connected to timer output P13.

A capacitor C23 and a series-connected pair of NPN power switching transistors Q23 and Q24 are connected in parallel with transistor Q10. It may be possible to omit capacitor C23 if windings L4B and L4X are tightly coupled. An inverter control circuit 160 has an input terminal P15, a first output terminal P16, and a second output terminal P17. Input terminal P15 is connected to timer output terminal P14. Output terminal P16 is connected to the base of transistor Q22, and output terminal P17 is connected to the base of transistor Q23.

A transformer T2 has a primary winding T2A and a secondary winding T2B. Winding T2A is connected between the junction of transistors Q23 and Q24 and the junction of capacitors C4 and C5. A capacitor C24 is connected in parallel with winding T2A to form a parallel-resonant tank circuit. The emitter-to-collector capacitances of transistors Q10, Q22, and Q23 are effectively connected in parallel with the primary winding of transformer T2. The self capacitance of inductor L4 is also effectively part of the parallel-resonant tank capacitance, but windings L4A and L4X are not effectively in parallel with the primary winding of transformer T2, and the inductance value of these windings has little effect on the resonant frequency of the parallel-resonant tank.

Lamps 70 and 71, and ballast capacitors C61 and C62 are connected in a manner identical to the circuit shown in FIG. 1 except that windings on inductor L4 and transformer T2 are used instead of the windings on inductor L3 and transformer T1. Ballasting impedance can also be provided by inductors or leakage inductance instead of capacitors C61 and C62.

The programmed start ballast circuit of FIG. 4 functions in a manner similar to that of the circuit shown in FIG. 1. The major operational differences are that, for a given dc input voltage, the voltage stresses on the components in the inverter and the clamp circuits are half of those produced by the circuit of FIG. 1. The filament voltage waveforms produced by the circuit of FIG. 4 are similar to those of FIG. 2, but the preheat voltage waveforms are more trapezoidal than those of FIG. 2(*a*) because of the snubbing effect of capacitor C23. Equations (1), (2), and (4) apply, given that $N_{AF}$ is the sum of the number of turns in main windings L4A and L4X divided by the number of turns in each of the filament output windings of L4, and $N_{BA}$ is equal to the sum of the number of turns in windings L4B and L4Y divided by the sum of the number of turns in windings L4A and L4X.

Figure 5:
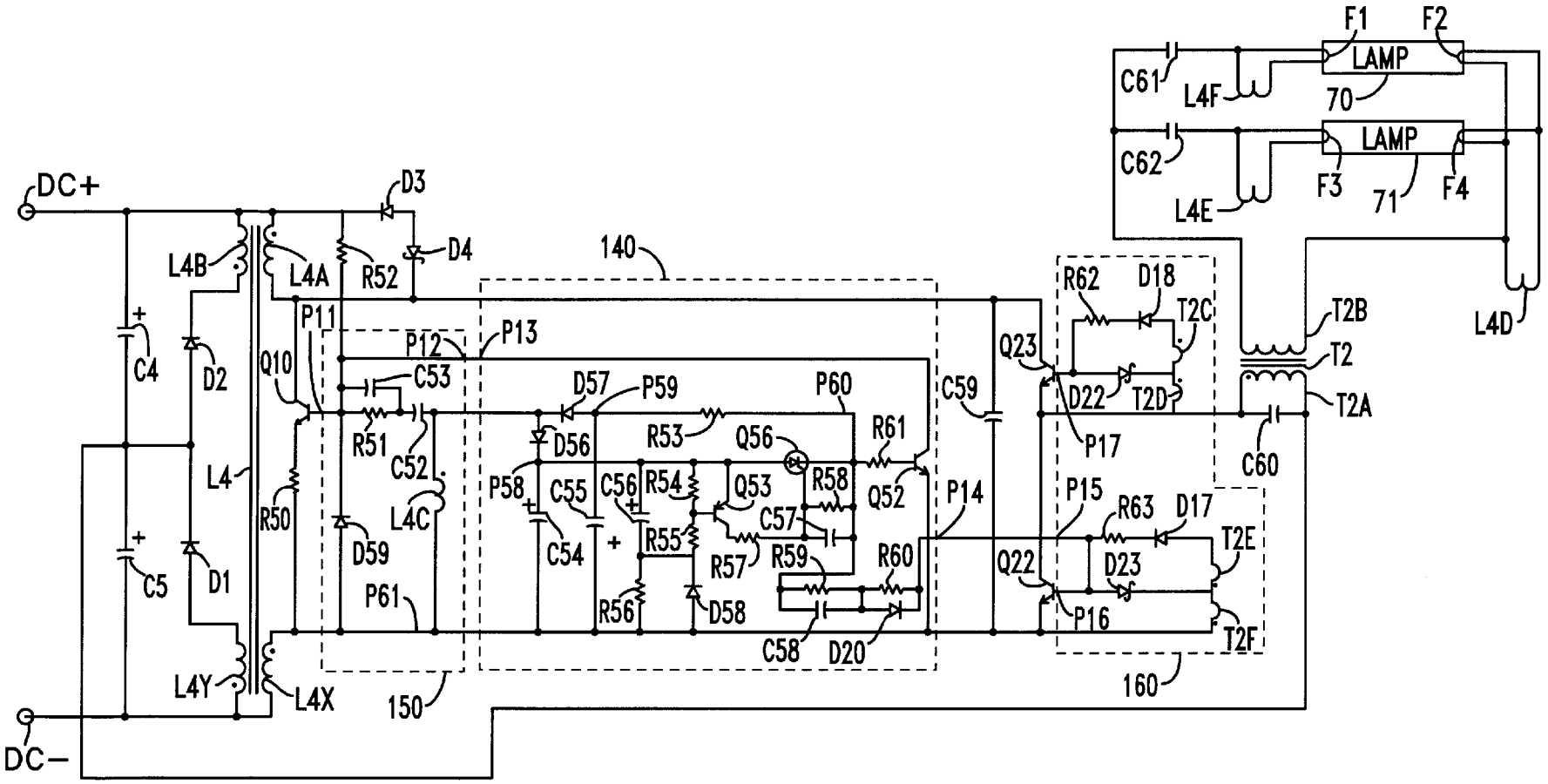
FIG. 5 is a detailed electrical schematic diagram of an embodiment of the electronic ballast circuit of FIG. 4.

FIG. 5 shows a more detailed version of the circuit of FIG. 4. Oscillator control 150 is implemented as a blocking oscillator. A resistor R52 is connected between DC+ and the base of transistor Q10 to provide a triple starting current. A terminal P61 series as a common terminal for oscillator control 150, timer 140 and inverter control 160. In FIG. 5, a resistor R50 that is not shown in FIG. 4 is inserted between the emitter of transistor Q10 and common terminal P61 to provide current limiting in case one or more of the filament windings is inadvertently shorted.

In addition to the four windings shown in FIG. 1, inductor L4 has a fifth winding, L4C to provide positive feedback for the oscillator. A base drive network consisting of a current limiting resistor R51, a dc blocking capacitor C52, and a speed-up capacitor C53 couples the feedback signal from the dotted end of winding L4C to the base of transistor Q10 through terminal P11. A diode D59 is connected between terminals P11 and P61.

The blocking oscillator of FIG. 5 operates in a manner similar to that described for FIG. 3 except that the main and clamp windings of inductor L4 are each split into two windings. When transistor Q10 turns off, the collector voltage is limited by clamp winding L4B and L4Y, and clamp diodes D1 and D2. A diode D3 and a zener diode D4 are connected in parallel with winding L4A. Windings L4B and L4Y each have more turns than windings L4A and L4X in order to limit the pea collector voltage to a level that prevents diodes D3 and D4 from conducting except during a brief interval when the leakage inductances between the main and clamp windings of inductor L4 allow an overshoot in the collector voltage of Q10. Diodes D3 and D4 provide protection for inverter transistors Q22 and Q23 during transient conditions. The function of diodes D3 and D4 could by also be accomplished by placing two series-connected zener diodes across transistors Q22 and Q23. However, the use of a regular diode for D3 and a zener diode for D4 results in a lower cost solution.

The clamp circuit comprising windings L4B and L4Y, and diodes D1 and D2 performs the same function as diode D5 and winding L3B in FIG. 3. In an alternative embodiment, the clamp circuit can be eliminated if diode D4 is selected to have a power rating sufficient to dissipate the portion of the energy in L4 that is not delivered to the filament load. In this alternative embodiment, the preheat filament voltage is approximately:

$$V_{fil} = \frac{V_{dc}}{N_{AF}} \sqrt{\frac{2V_z}{V_{dc}} - 1} \tag{6}$$

where $V_Z$ is the breakdown voltage of zener diode D10, and $N_{AF}$ is the sum of the number of turns in main windings L4A and L4X divided by the number of turns in each of the filament output windings of L4. $F_{OSC}$ is approximately:

$$F_{osc} = \frac{V_z - 0.5V_{dc}}{T_{on}V_z} \tag{7}$$

The ac voltage across winding L4C is rectified to form two power supplies for timer 140. A diode D56 is connected between winding L4C and an electrolytic capacitor 54 to form a positive power supply of about 12 volts with respect to terminal P61 at a terminal P58. A diode D57 is connected between winding L4C and a capacitor C55 to form a negative power supply of about −10 volts with respect to terminal P61 at a terminal P59. A resistor R53 is connected between negative power supply terminal P59 and a terminal P60.

The timing function of timer 140 is provided by an RC network consisting of an electrolytic capacitor C54, and resistors R54, R55, and R56, which are connected in series between terminals P58 and P61. Capacitor C54 is connected in parallel with resistors R54 and R55, and a diode D58 is connected in parallel with resistor R56. A PNP transistor Q53 has an emitter connected to positive power supply terminal P58, and a base connected to the junction of R54 and R55. The collector of transistor Q53 is coupled to the gate of an SCR Q56 through a resistor R57. The anode of SCR Q56 is connected to terminal P58 and the cathode is connected to a terminal P60. A resistor R58 and a capacitor C57 are connected in parallel between the gate and cathode of SCR Q56. An NPN transistor Q52 has an emitter connected to terminal P61, and a collector connected to terminal P13. The base of transistor Q52 is coupled to terminal P60 through a resistor R61. Resistors R59 and R60 are connected in series between terminals P60 and P14. A capacitor C58 is connected in parallel with resistor R59, and a diode D20 is connected in parallel with resistor R60.

Inverter control 160 is synchronized to the resonant tank voltage through a set of feedback windings T2C, T2D, T2E, and T2F on transformer T2. Windings T2C and T2D are connected in series, with the non-dotted end of winding T2D connected to the emitter of transistor Q23. A schottky diode D22 is connected between output terminal P17 and the junction of windings T2C and T2D. A diode D18 and a resistor R62 are connected in series between the dotted end of T2C and terminal P17.

Windings T2E and T2F are connected in series, with the dotted end of winding T2F connected to the emitter of transistor Q22. A schottky diode D23 is connected between output terminal P16 and the junction of windings T2E and T2E. A diode D17 and a resistor R63 are connected in series between the non-dotted end of T2E and the terminal P16. Input terminal P15 is connected to output terminal P16.

Diode D18 and resistor R62 provide forward base current for transistor Q23 when the dotted ends of the windings of T2 are positive. Schottky diode D22 turns transistor Q23 off when the dotted ends of the windings of T2 are negative. The base drive for transistor Q22 is out of phase with the base drive of transistor Q23.

Timing circuit 140 operates in a manner similar to timer 40, except for the function of some coupling circuitry between terminals P60 and P14 that is not present in timer 40. In order to prevent premature starting of the parallel-resonant inverter, P14 is held negative during the preheat interval by the bias voltage provided through resistors R53, R59, and R60. At the end of the preheat interval, SCR Q56 fires, and a starting pulse is coupled to the base of transistor Q22 through capacitor C58, diode D20, and terminals P14, P15, and P16. The values of R59 and R60 are chosen to be large enough that the coupling circuit has minimal interaction with the operation of inverter control 160 after the parallel-resonant inverter begins operation.

Component values for a ballast built to demonstrate the circuit of FIG. 5 are shown in Table 2.

TABLE 2

Component values for FIG. 5.

| Component | Value or Part # | Component | Value or Part # |
|---|---|---|---|
| Q10 | BUL128 | D20 | 1N4148 |
| Q52 | 2N4401 | R3 | 220 Ω |
| Q53 | MPS3906 | R4 | 6.2K Ω |
| Q22, Q23 | BUL128 | R5 | 47K Ω |
| Q56 | 2N5061 | R6 | 10 kΩ |
| D1 | UF4007 | R22 | 720 kΩ |
| D2 | UF4007 | D22 | 1N5819 |
| D3 | UF4007 | D23 | 1N5819 |
| D4 | P6KE320A | R7 | 117 kΩ |
| D6 | EGP10A | R8 | 1 kΩ |
| D7 | 1N4148 | R10 | 1 kΩ |
| D9 | 1N4148 | R11 | 3 Ω |
| D17 | EGP10A | R12 | 220 Ω |
| D18 | EGP10A | R18 | 220 Ω |
| C4 | 47 uF | R23 | 240 Ω |

TABLE 2-continued

Component values for FIG. 5.

| Component | Value or Part # | Component | Value or Part # |
|---|---|---|---|
| C5 | 47 uF | R24 | 240 Ω |
| C6 | 100 nF | R19 | 470 Ω |
| C7 | 2.2 nF | C13 | 2.7 nF |
| C8 | 100 uF | C14 | 2.7 nF |
| C9 | 100 nF | C21 | 100 nF |
| C10 | 100 uF | C23 | 1.0 nF |
| C11 | 47 nF | C24 | 10 nF |

Figure 6:
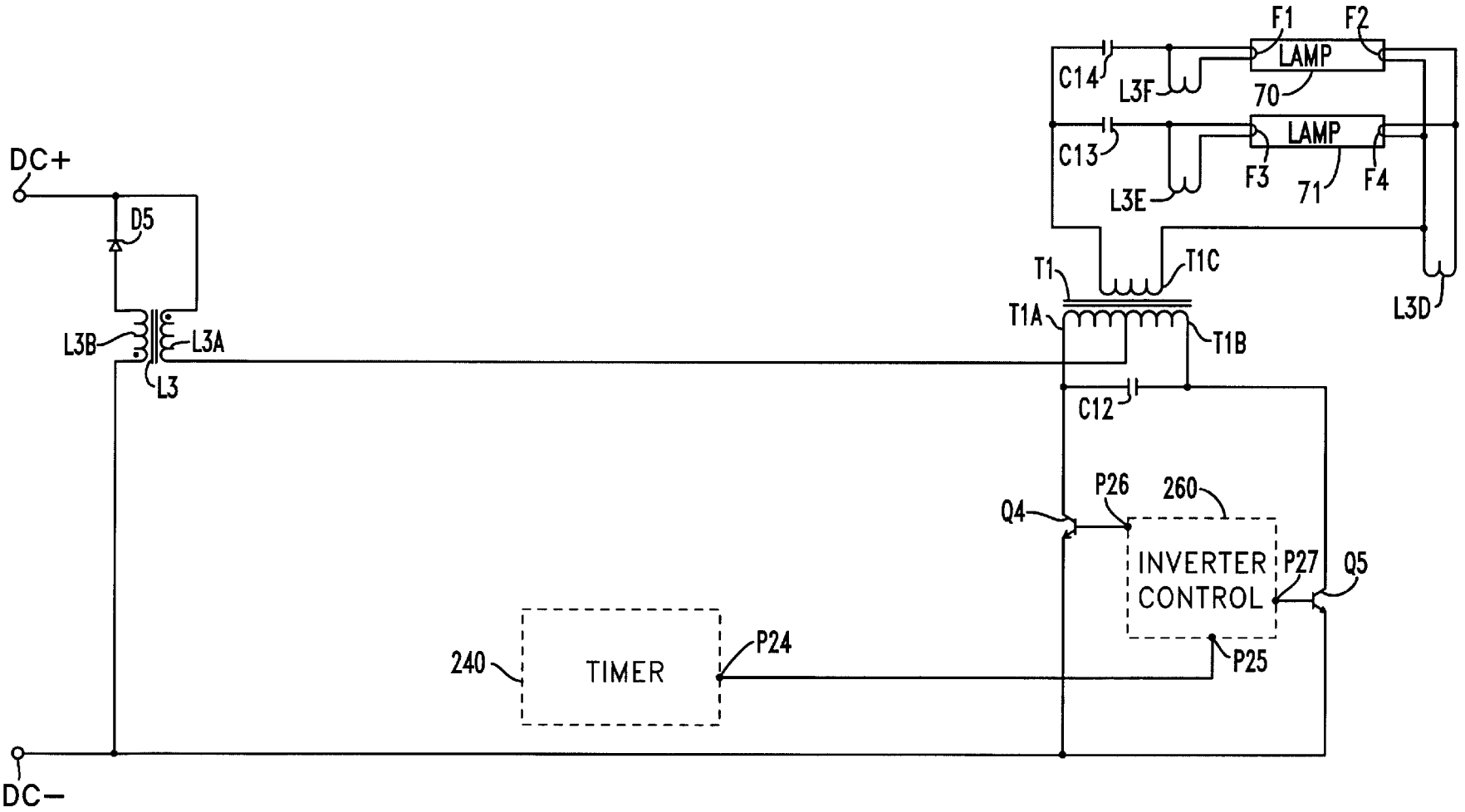
FIG. 6 is a simplified diagram of a programmed start electronic ballast having a dual-mode, push-pull parallel-resonant inverter in which the same two switching transistors are used in both the preheat and normal operating modes.

FIG. 6 is variation of the a programmed start electronic ballast of FIG. 1 in which the same two switching transistors are used in both the preheat and normal operating modes. An inverter control circuit 260 has an input terminal P25, a first output terminal P26, and a second output terminal P27. Output terminal P26 is connected to the base of transistor Q4, and output terminal P27 is connected to the base of transistor Q5. A timer circuit 240 has an output terminal P24 that is connected to inverter control input terminal P25.

When power is first applied to the ballast, timer 240 sends a preheat signal to inverter control 260. When inverter control 260 receives the preheat signal, it forces transistor Q4 and Q5 to be simultaneously switched on and off. This produces the same effect that transistor Q1 does in the circuit of FIG. 1. The filament voltage waveforms will be similar to those of FIG. 2(*a*), and the voltage across winding T1C will be essentially zero. At the end of the preheat interval, timer 240 sends a signal to inverter control 260 that causes it to alternately switch transistors Q4 and Q5, in synchronism with the resonant tank voltage. Transistor Q4 is operated out of phase with transistor Q5. The filament voltage waveforms will be similar to those of FIG. 2(*b*), and the voltage across winding T1C will then be sufficient to strike and operate the lamps.

An alternative realization of the push-pull parallel-resonant inverter of FIG. 6 can be obtained by repositioning winding L3A. In the alternative embodiment, the junction of windings T1A and T1B is connected to DC+, and winding L3A is inserted between DC− and the junction of the emitters of transistors Q4 and Q5.

Figure 7:
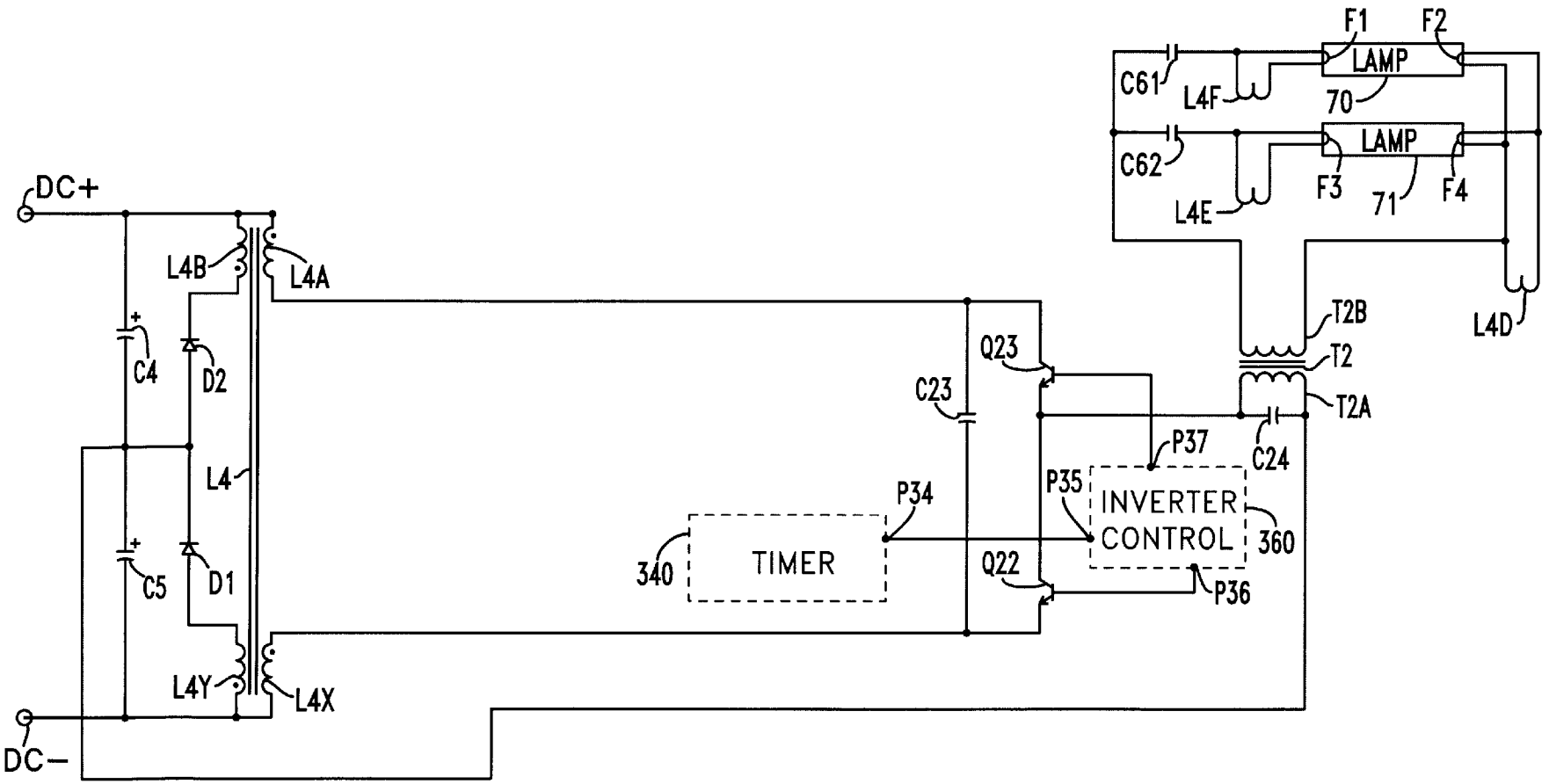
FIG. 7 is a simplified diagram of a programmed start electronic ballast having a dual-mode, half-bridge parallel-resonant inverter in which the same two switching transistors are used in both the preheat and normal operating modes.

FIG. 7 is variation of the programmed start electronic ballast of FIG. 4 in which the same two switching transistors are used in both the preheat and normal operating modes. An inverter control circuit 360 has an input terminal P35, a first output terminal P36, and a second output terminal P37. Output terminal P36 is connected to the base of transistor Q22, and output output terminal P27 is connected to the base of transistor Q23. A timer circuit 340 has an output terminal P34 that is connected to inverter control input terminal P35.

When power is first applied to the ballast, timer 340 sends a preheat signal to inverter control 360. When inverter control 360 receives the preheat signal, it forces transistors Q22 and Q23 to be simultaneously switched on and off. This produces the same effect that transistor Q10 does in the circuit of FIG. 4. The filament voltage waveforms will be similar to those of FIG. 2(*a*), and the voltage across winding T2B will be essentially zero. At the end of the preheat interval, timer 340 sends a signal to inverter control 360 that causes it to alternately switch transistors Q22 and Q23 in synchronism with the resonant tan voltage. Transistor Q22 is operated out of phase with transistor Q23. The filament voltage waveforms will be similar to those of FIG. 2(*b*), and the voltage across winding T2B will then be sufficient to strike and operate the lamps.

An alternative realization of half-bridge parallel-resonant inverter of FIG. 7 can be obtained by repositioning main DC choke windings L4A and L4B, and transistors Q23 and Q23. An alternative embodiment of the present invention can be formed by interchanging winding L4A with transistor Q23, and by interchanging winding L4X with transistor Q22. Windings L4A and L4X are joined together, and this junction is connected to winding T2A. The collector of transistor Q23 is connected to DC+, and the emitter of transistor Q22 is connected to DC−. Transistors Q22 and Q23 are operated in the manner described for the circuit of FIG. 7 to obtain the two ballast operating modes.

Figure 8:
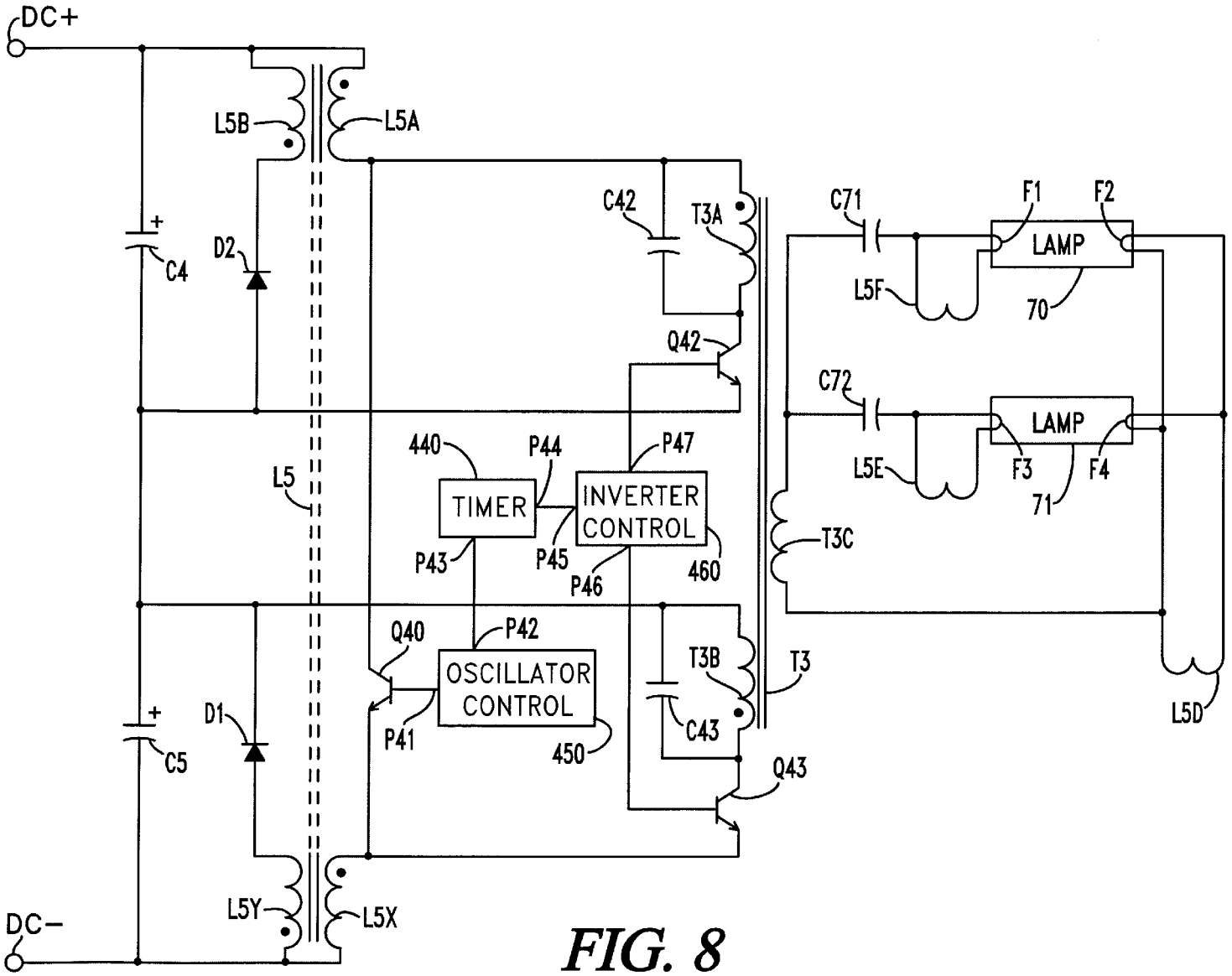
FIG. 8 is a simplified diagram of a programmed start electronic ballast having a dual-mode, split-tank parallel-resonant inverter.

FIG. 8 shows a simplified diagram of a programmed start electronic ballast that utilizes a split-tan parallel-resonant inverter. This type of inverter can be used with higher voltages between terminals DC+ and DC− than the push-pull parallel-resonant inverters shown in FIGS. 1 and 3. Under normal operating conditions, the peak voltage that appears across the inverter switching transistors is approximately $\pi/2$ times the dc input voltage. The circuit of FIG. 8 is particularly useful when the dc voltage between terminals DC+ and DC− is greater than about 400 volts.

Electrolytic capacitors C4 and C5 are connected in series between terminals DC+ and DC−. These capacitors are typically part of a dc power supply that is not shown. Capacitors C4 and C5 are shown because there are connections to the junction between them. These capacitors do not have to be electrolytic capacitors if sufficient capacitive energy storage is present in the dc power supply. It is possible to leave out either of capacitors C4 or C5 if the dc power supply provides capacitance between terminals DC+ and DC−.

A dc choke inductor L5 has main windings L5A and L5X, clamp windings L5B and L5Y, and filament windings L5D, L5E, and L5F. Winding L5A, an NPN power switching transistor Q40 and winding L5X are connected in series between DC+ and DC−. Winding L5B, diodes D1 and D2, and winding L5Y are also connected in series between DC+ and DC−. The junction where diodes D1 and D2 are connected together is connected to the junction of capacitors C4 and C5. It is possible to use a single clamp winding and diode as in FIG. 1, but the circuit shown in FIG. 8 has the advantage that diodes D1 and D2 each see half the reverse voltage that a single diode would see if only one clamp winding were used.

An oscillator control circuit 450 has an output terminal P41, and an inhibit terminal P42. Output terminal P41 is connected to the base of transistor Q40. A timer circuit 440 has a first timer output terminal P43 and a second timer output terminal P44. Inhibit terminal P42 is connected to timer output P43.

A resonant transformer T3 has a pair of primary windings, T3A and T3B, and a secondary windings T3C. A capacitor C42 is connected in parallel with winding T3A, and a capacitor C43 is connected in parallel with windings T3B, to form a split tank circuit. A transistor Q42 is connected between winding T3A and the junction of capacitors C4 and C5.

An inverter control circuit 460 has an input terminal P45, a first output terminal P46, and a second output terminal P47. Input terminal P45 is connected to timer output terminal P44. Output terminal P46 is connected to the base of transistor Q43, and output terminal P47 is connected to the base of transistor Q42.

The emitter-to-collector capacitances of transistors Q20, Q42, and Q43 are effectively connected in parallel with the primary windings of transformer T3. The self capacitance of inductor L5 is also effectively part of the parallel-resonant tank capacitance, but windings L5A and L5X are not effectively in parallel with the primary windings of transformer T3, and the inductance value of these windings has little effect on the resonant frequency of the parallel-resonant tank.

Lamps 70 and 71, and ballast capacitors C71 and C72 are connected in a manner identical to the circuit shown in FIG. 1 except that windings on inductor L5 and transformer T3 are used instead of the windings on inductor L3 and transformer T1. Ballasting impedance can also be provided by inductors or leakage inductance instead of capacitors C71 and C72.

The programmed start ballast circuit of FIG. 8 functions in a manner similar to that of the circuit shown in FIG. 4. Equations (1), (2), and (4) apply, given that $N_{AF}$ is the sum of the number of turns in main windings L5A and L5X divided by the number of turns in each of the filament output windings of L5, and $N_{BA}$ is equal to the sum of the number of turns in windings L5B and L5Y divided by the sum of the number of turns in windings L5A and L5X.

An alternative embodiment of the circuit of FIG. 8 can be obtained by omitting auxiliary transistor Q20. Similar to the circuit of FIG. 7, transistors Q42 and Q43 can be operated in unison during preheating, and operated out of phase during normal operation. Another alternative embodiment can implement without clamp windings L5B and L5Y, and clamp diodes D1 and D1, if a zener diode clamp circuit is used to dissipate leftover energy in inductor L5 during preheating, similar to the arrangement of diodes D3 and D4 in FIG. 5, provided that zener diode D4 can dissipate the power delivered by L5.

Various permutations of the parallel-resonant inverter of FIG. 8 can be obtained by reordering the series connections of a dc choke main winding, a resonant transformer primary winding, and a transistor. For example, the parallel-resonant inverter of FIG. 8 can be rearranged with winding L5X connected between the junction of capacitors C4 and C5 to form a circuit similar to the one shown in FIG. 1 of U.S. Pat. No. 4,513,226. This arrangement does not allow a single auxiliary transistor to be used for preheating, but transistors Q42 and Q43 can be operated in unison during preheating, and operated out of phase during normal operation.

Full-bridge parallel-resonant inverters can be used to realize additional embodiments of the present invention. Examples of two of the many possible full-bridge parallel-resonant inverter topologies are found in FIG. 1 of U.S. Pat. No. 4,692,667 and FIG. 5 of U.S. Pat. No. 5,166,869. If an auxiliary switch is used, it should be connected in parallel with the input terminals of the bridge. The resonant inductance is connected between the output terminals of the bridge. For example, in the circuit shown in FIG. 1 of U.S. Pat. No. 4,692,667, the auxiliary switch would be connected between the bridge input terminals labeled B+ and B−. The resonant inductance is connected between the bridge output terminals, labeled Ja and Jb.

Full-bridge embodiments are also possible without using an auxiliary switch. During the preheat mode, all four bridge transistors are operated in unison. During normal operation, the bridge transistors are alternately operated diagonal pairs such that a sinusoidal voltage is developed across the resonating inductance. For example, in the circuit in FIG. 1 of U.S. Pat. No. 4,692,667, transistors Q1*a* and Q2*b* would be on, followed by transistors Q1*b* and Q2*a*.

As with other embodiments of the present invention, full-bridge embodiments can be implemented with dc choke clamp windings and clamp diodes that return energy to the dc power supply, or with zener diode clamps that dissipate energy.

The present invention has been described in connection with a preferred embodiment thereof, and it will be understood that many modifications and variations will be readily apparent to those of ordinary skill in the art without departing from the spirit or scope of the invention and that the invention is not to be taken as limited to all of the details herein. Therefore, it is manifestly intended that this invention be limited only by the claims and the equivalents thereof.

What is claimed is:

1. A programmed start electronic ballast for operating a fluorescent lamp load comprising:

a dc power supply;

a parallel-resonant inverter connected to the dc power supply and operable to provide high-frequency power, the parallel-resonant inverter having a dc choke inductor, and a resonant inductance means effectively connected in parallel with a resonant capacitance;

an auxiliary switching means connected to the dc choke inductor, the auxiliary switching means having at least one controlled switching device;

timing means connected to the parallel-resonant inverter and to the auxiliary switching means, and operable to produce a first operating mode and a second operating mode for the electronic ballast;

a plurality of windings coupled to the dc choke inductor for providing lamp filament heating power; and at least one ballasting impedance means coupled to the resonant inductance means for coupling high frequency power from the parallel-resonant inverter to the fluorescent lamp load;

the first operating mode characterized by the parallel-resonant inverter being inhibited and the auxiliary switching means developing a first voltage waveform across the dc choke inductor; and the second operating mode characterized by the auxiliary switching means being inhibited and the parallel-resonant inverter producing an essentially sinusoidal voltage across the resonant inductance means while producing a second voltage waveform across the dc choke inductor, the magnitude of the second voltage waveform being less than the magnitude of the first voltage waveform.

2. The programmed start electronic ballast of claim 1 in which the first voltage waveform has a substantially trapezoidal shape, and the second voltage waveform has a shape which is substantially that of a full-wave rectified sine wave, but has an average value that is approximately zero.

3. The programmed start electronic ballast of claim 1 further comprising:

a clamp diode; and a clamp winding coupled to the dc choke inductor and connected in series with the clamp diode so that energy is directed into the dc power supply when the clamp diode conducts.

4. The programmed start electronic ballast of claim 1 wherein the parallel-resonant inverter further comprises:

a first and a second transistor connected between the resonant inductance means and the dc power supply, the dc choke inductor having a main winding connected between the dc power supply and the resonant inductance means.

5. The programmed start electronic ballast of claim 1 wherein the parallel-resonant inverter further comprises:

a first and a second transistor;

the resonant inductance means connected to the dc power supply, the first and the second transistor connected to the resonant inductance means, the first and second transistors connected at a junction, and the dc choke inductor having a main winding connected between the dc power supply and the junction of the first and second transistors.

6. The programmed start electronic ballast of claim 1 wherein the parallel-resonant inverter further comprises:

a first dc terminal connected to the dc power supply;

a second dc terminal connected to the dc power supply;

a first and a second transistor;

the dc choke inductor having a first main winding and a second main winding, the first main winding connected to the first dc terminal, and the second main winding connected to the second dc terminal;

the first transistor connected between the first main winding of the dc choke inductor and the resonant inductance means, and the second transistor connected between the second main winding of the dc choke inductor and the resonant inductance means.

7. The programmed start electronic ballast of claim 1 wherein the parallel-resonant inverter further comprises:

a first transistor and a second transistor;

the dc choke having a first main winding and a second main winding, the resonant inductance means having a first primary winding and a second primary winding;

the first main winding, the first primary winding, and the first transistor connected in series, and the second main winding, the second primary winding, and the second transistor connected in series.

8. The programmed start electronic ballast of claim 1 wherein the parallel-resonant inverter further comprises:

a bridge having a first bridge input terminal, a second bridge input terminal, a first bridge output terminal and a second bridge output terminal;

a first transistor, the first transistor connected between the first bridge input terminal and the first bridge output terminal;

a second transistor, the second transistor connected between the first bridge output terminal and the second bridge input terminal;

a third transistor, the third transistor connected between the first bridge input terminal and the second bridge output terminal;

a fourth transistor, the fourth transistor connected between the second bridge output terminal and the second bridge input terminal;

the dc choke inductor having a winding connected to one of the bridge input terminals, and the resonant inductance means having a winding connected between the first and the second bridge output terminals.

9. A programmed start electronic ballast for operating a fluorescent lamp load comprising:

a dc power supply;

a first and a second set of controlled switching devices, each set having at least one controlled switching device;

an inverter control means connected to the sets of controlled switching devices;

a dc choke inductor;

a resonant inductance means;

a resonant capacitance, the resonant capacitance effectively connected in parallel with the resonant inductance means;

the first and the second set of controlled switching devices, the inverter control means, the dc choke inductor, the resonant inductance means, and the resonant capacitance connected to form a parallel-resonant inverter operable to provide high-frequency power, the dc power supply connected to the parallel-resonant inverter;

timing means connected to the inverter control means, and operable to produce a first and a second operating mode for the electronic ballast;

a plurality of windings coupled to the dc choke inductor for providing lamp filament heating power; and at least one ballasting impedance means coupled to the resonant inductance means for coupling high frequency power from the parallel-resonant inverter to the fluorescent lamp load;

the first operating mode characterized by the first set and the second set of controlled switching devices operating in unison to develop a first voltage waveform across the dc choke inductor; and the second operating mode characterized by the first set of controlled switching deices operating out of phase with the second set of controlled switching devices so that the parallel-resonant inverter produces an essentially sinusoidal voltage across the resonant inductance means while producing a second voltage waveform across the dc choke inductor, the magnitude of the second voltage waveform being less than the magnitude of the first voltage waveform.

10. The programmed start electronic ballast of claim 9 in wherein the first voltage waveform has a substantially trapezoidal shape, and the second voltage waveform has a shape which is substantially that of a full-wave rectified sine wave, but has an average value that is approximately zero.

11. The programmed start electronic ballast of claim 9 further comprising:

a clamp diode; and a clamp winding coupled to the dc choke inductor and connected in series with the clamp diode such that energy is directed into the dc power supply when the clamp diode conducts.

12. The programmed start electronic ballast of claim 9 further comprising:

a dissipative clamp means coupled to the dc choke inductor such that energy is dissipated in the dissipative clamping means during the first operating mode.

13. The programmed start electronic ballast of claim 9 wherein:

the first and second sets of controlled switching devices are connected between the resonant inductance means and the dc power supply, the dc choke inductor having a main winding connected between the dc power supply and the resonant inductance means.

14. The programmed start electronic ballast of claim 9 wherein:

the resonant inductance means is connected to the dc power supply, the first and second sets of controlled switching devices are connected at a junction, and the dc choke inductor has a main winding connected between the dc power supply and the junction of the first and second sets of controlled switching devices.

15. The programmed start electronic ballast of claim 9 wherein the parallel-resonant inverter further comprises:

a first dc terminal connected to the dc power supply and a second dc terminal connected to the dc power supply;

the dc choke inductor having a first main winding and a second main winding, the first main winding connected to the first dc terminal, and the second main winding connected to the second dc terminal;

the first set of controlled switching devices connected between the first main winding of the dc choke inductor and the resonant inductance means, and the second set of controlled switching devices connected between the second main winding of the dc choke inductor and the resonant inductance means.

16. The programmed start electronic ballast of claim 9 wherein the parallel-resonant inverter further comprises:

a first dc terminal connected to the dc power supply and a second dc terminal connected to the dc power supply;

the dc choke inductor having a first main winding and a second main winding, the first main winding and the second main winding connected to the resonant inductance means;

the first set of controlled switching devices connected between the first dc terminal and the first main winding of the dc choke inductor, and the second set of controlled switching devices connected between the second dc terminal and the second main winding of the dc choke inductor.

17. The programmed start electronic ballast of claim 9 further comprising:

the dc choke having a first main winding and a second main winding;

the resonant inductance means having a first primary winding and a second primary winding;

the first main winding, the first primary winding, and the first set of controlled switching devices connected in series; and the second main winding, the second primary winding, and the second set of controlled switching devices connected in series.

18. The programmed start electronic ballast of claim 9 wherein the parallel-resonant inverter further comprises:

a bridge having a first bridge input terminal, a second bridge input terminal, a first bridge output terminal and a second bridge output terminal;

the first set of controlled switching devices connected between the first bridge input terminal and the second bridge input terminal, the second set of controlled switching devices connected between the first bridge input terminal and the second bridge input terminal;

the dc choke inductor having a winding connected to one of the bridge input terminals, and the resonant inductance means having a winding connected between the first and the second bridge output terminals.

19. A ballast circuit having a plurality of output terminals for connection to at least one gas discharge lamp, the ballast circuit adapted to preheat a plurality of lamp filaments prior to lamp arc ignition, the ballast circuit comprising:

a dc power supply;

oscillator means connected to the dc power supply and operable to supply a filament voltage to the lamp filaments for a first period of time prior to lamp arc ignition;

an inverter connected the dc power supply and to the oscillator means;

a dc choke inductor having a first winding connected in common to the inverter and to the oscillator means, the dc choke inductor having a plurality of filament windings coupled to the first winding and connected to the output terminals, the filament windings supplying the filament voltage;

timer means connected with the oscillator means and the inverter, the timer means operable to inhibit the inverter during the first period time, and after the first period of time, operable to inhibit the oscillator means, and to initiate oscillations in the inverter such that the inverter provides a high frequency ac voltage at the output terminals.

20. The ballast circuit according to claim 19, further comprising:

a first transistor connected to the first winding;

an oscillator control circuit connected to the transistor and to the timer, and operable to cause the firs transistor to switch between an on state and an off state.

21. The ballast circuit according to claim 19, wherein the first period of time has a duration ranging from 300 to 1500 milliseconds.

22. The ballast circuit according to claim 19, wherein the pre-heat filament voltage is characterized by:

(i) having a first magnitude during the first period of time;

(ii) having a second magnitude after the first period of time; and (iii) the second magnitude having a value less than the first magnitude.

23. A programmed start ballast for operating at least one fluorescent lamp comprising:

a dc power supply;

a parallel-resonant inverter connected to the dc power supply, the parallel-resonant inverter operable to provide a high-frequency voltage, the parallel-resonant inverter having a dc choke inductor and a resonant transformer;

an auxiliary transistor connected to the dc supply and to the inductor;

an oscillator control means connected to the auxiliary transistor;

timing means connected to the parallel-resonant inverter and to the oscillator control means to provide for the ballast a first operating mode followed a second operating mode;

the first mode characterized by the parallel-resonant inverter being inhibited, and by the oscillator control means operating to cause periodic switching of the auxiliary transistor such that a first voltage waveform is developed across the dc choke inductor;

the second mode characterized by the oscillator control means being inhibited, and by the parallel-resonant inverter operating to provide the high-frequency voltage, and to provide a second voltage waveform across the dc choke inductor, the magnitude of the second voltage waveform being less than the magnitude of the first voltage waveform;

a plurality of windings coupled to the dc choke inductor for providing lamp filament heating power.

24. The programmed start ballast of claim 23 further comprising:

a first inverter switching transistor and a second inverter switching transistor;

first coupling means for coupling the timer to the first switching transistor;

second coupling means for coupling the timer to the second switching transistor, the second coupling means operable to delay transmission of a bias current passing from the timer means to the second inverter switching transistor to prevent simultaneous conduction of the first and the second switching transistors at the beginning of the second operating mode.

* * * * *